US005485891A

United States Patent [19]

Vladimirovich et al.

[11] Patent Number: 5,485,891

[45] Date of Patent: Jan. 23, 1996

[54] CONE DRILL BIT

[75] Inventors: Brazhentsev A. Vladimirovich, Moscow; Brazhentsev V. Pavlovich, Moskovskaya, both of Russian Federation

[73] Assignee: Obshestvo S Organichennoi Otvetstvennostju "Nauchino-Proizvodstvennaya Firma Spettsstroyservis" , Moscow, Russian Federation

[21] Appl. No.: 215,078

[22] Filed: Mar. 21, 1994

[30] Foreign Application Priority Data

Oct. 11, 1993 [RU] Russian Federation ..... 93047140

[51] Int. Cl.[6] ..... E21B 10/00

[52] U.S. Cl. ..... 175/372; 175/371; 384/95; 384/108

[58] Field of Search ..... 175/371, 372, 175/327, 331, 339; 384/95, 108

[56] References Cited

U.S. PATENT DOCUMENTS

| | | | |
|---|---|---|---|
| 3,303,898 | 2/1967 | Bercaru | 175/372 X |
| 4,359,113 | 11/1983 | Morris | 175/372 X |
| 4,448,268 | 5/1984 | Fuller | 175/372 X |
| 4,825,964 | 5/1989 | Rives | 175/371 |
| 5,016,719 | 5/1991 | White | 175/372 X |

*Primary Examiner*—Roger J. Schoeppel

*Attorney, Agent, or Firm*—Stephen M. Evans; David L. Garrison

[57] ABSTRACT

A cone drill bit includes legs and attached to them trunnions with cones mounted thereon. A support unit for mounting the cones upon the trunnions includes a strengthened radial thrust ball bearing which transmits a load directed along a cone centerline. Strengthening the ball bearing in order to increase a bit wear resistance is attained by using the balls which diameter is appropriately related to the bit diameter as well as by strengthening a shoulder on the trunnion between the ball and peripheral roller bearings.

2 Claims, 3 Drawing Sheets

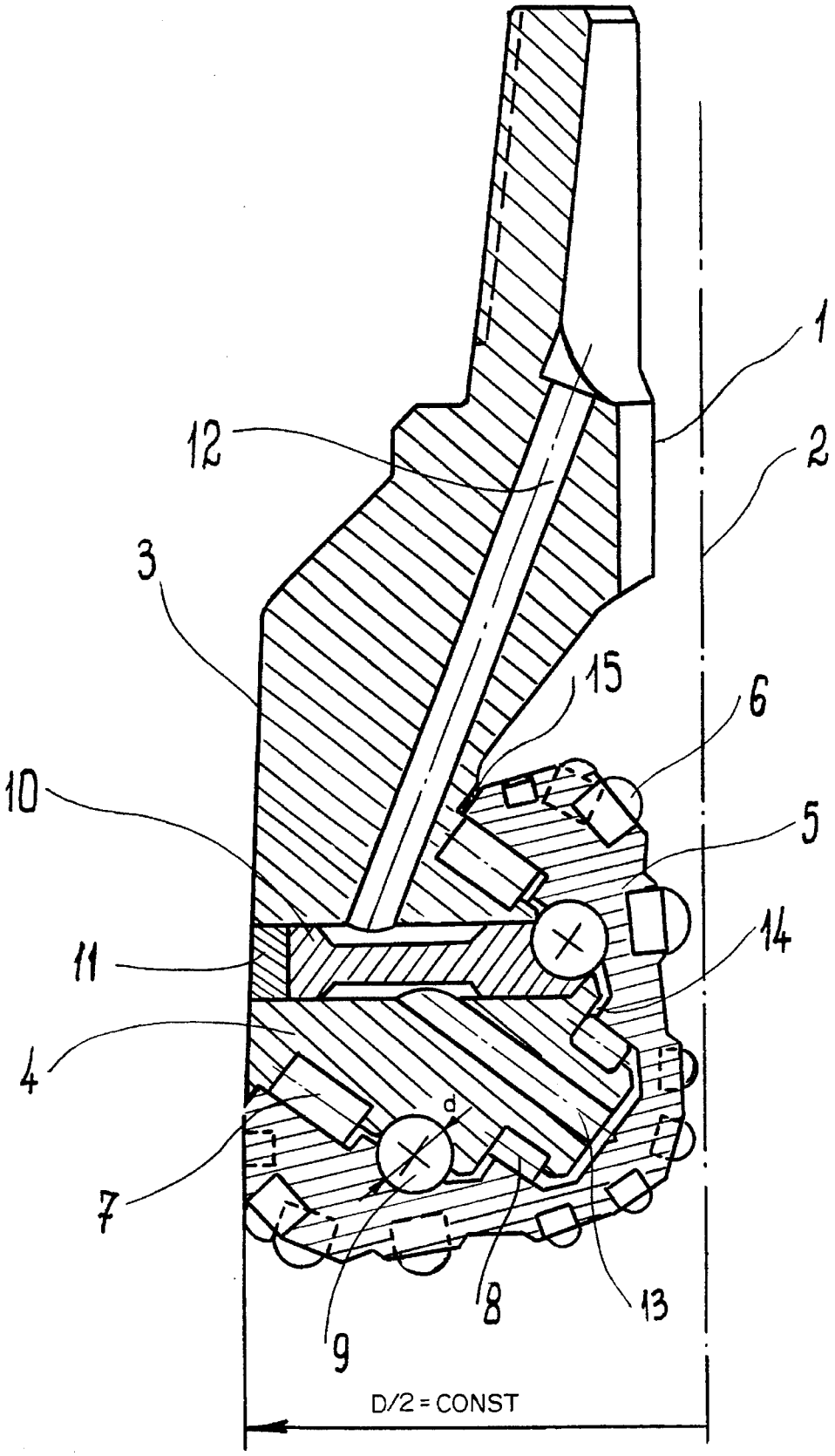
Фиг. 1

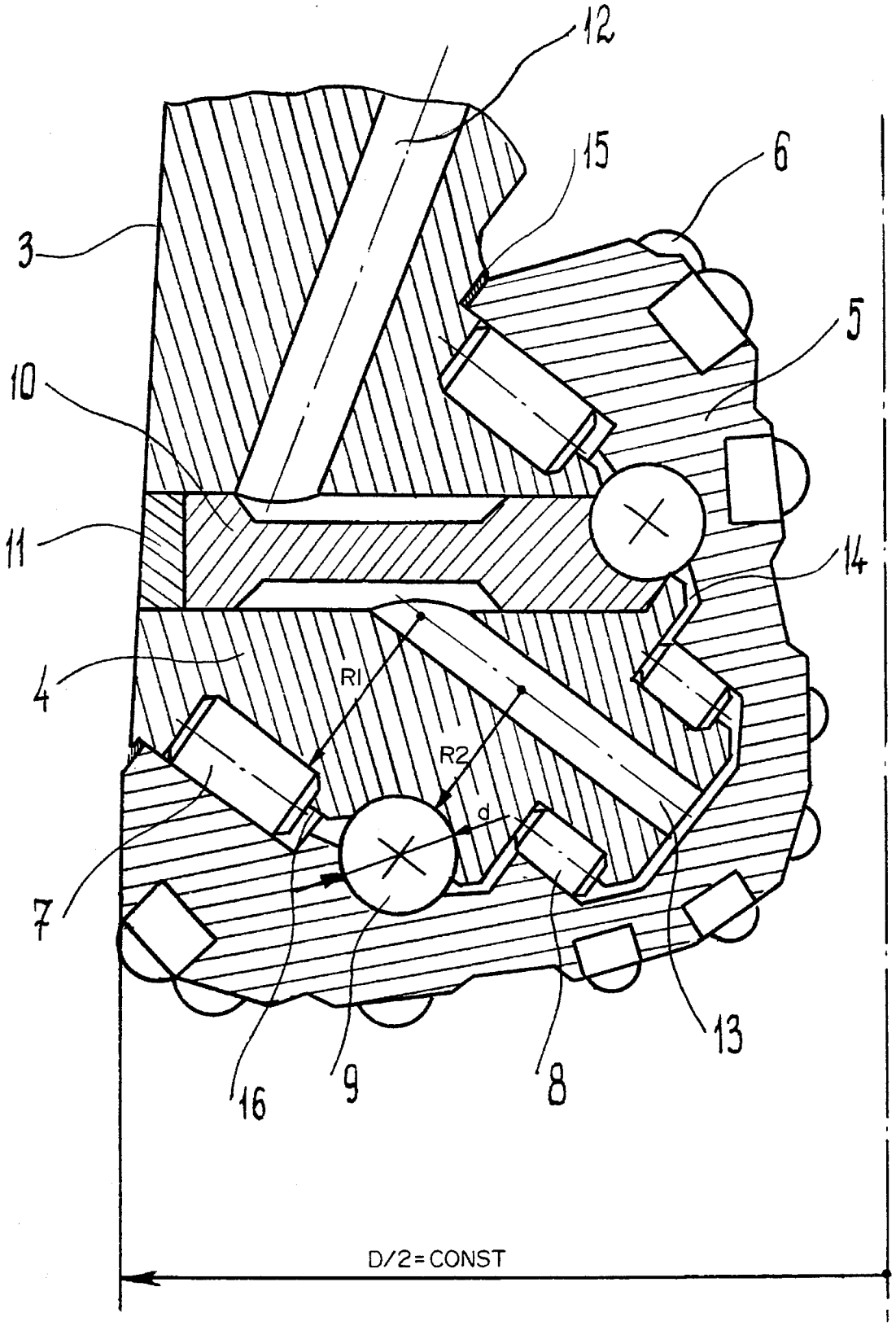
Фиг. 2

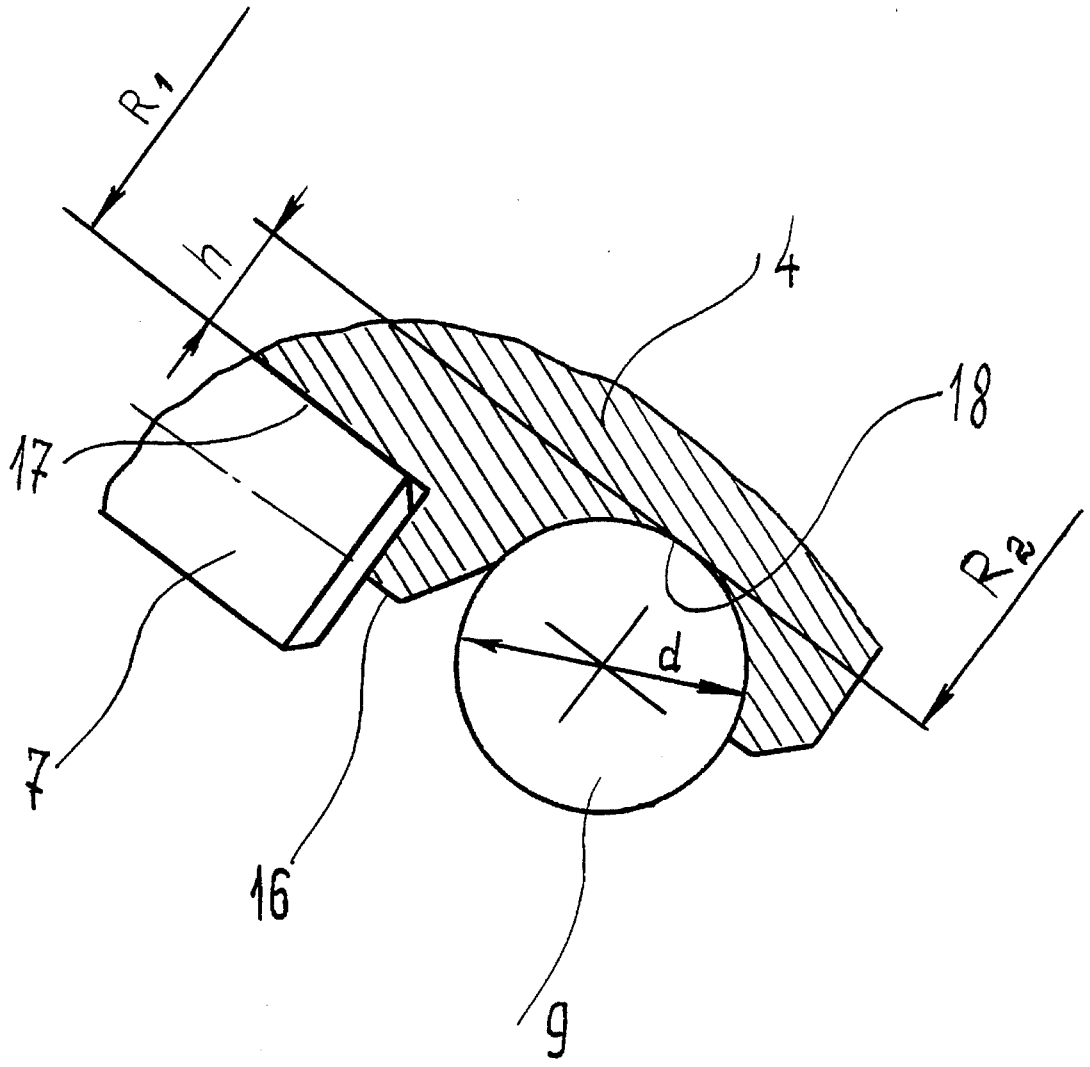
Фиг.3

CONE DRILL BIT

BACKGROUND OF THE INVENTION

1. Field of the Invention

The present invention relates to the field of machine building for a mining industry and, more particularly, to the bits for hole drilling with an air or gas cleaning of a hole face. The improvement of this design relates to the support unit which serves for rotatably mounting each cone on a leg trunnion and fixing it against axial displacement.

2. Description of the Prior Art and its Disadvantages

Development of the cone drill bits equipped with hard-alloy inserts has made the rock cone drilling the prevailing method for hard minerals exploration by open-cut mining and for the construction industry replacing a churn drilling and, partially, air percussion, percussion-rotary, auger drilling etc.

A specific feature of the rock cone bit drilling is cleaning a hole face with compressed air.

When in operation, a drill bit is subjected to high specific loads with increased vibration caused by high strength and fracturing of the drilled rock. Moreover, heat removal from the cone support units as compared to a water or solution flush drilling is imbarrased.

That's why, a commonly known cone bit support unit (hereinafter a support) including a radial roller bearing adjacent to the trunnion base, locking radial thrust ball bearing in the center and radial thrust roller bearing or radial rolling bearing adjacent to the end of the trunnion has become widely used.

Russia and Ukraine plants produce rock drill bits under a "roller-ball-roller" (RBR) scheme, i.e. on the rolling bearings. Companies of U.S., Sweden and other countries produce rock drill bits under a "roller-ball-thrust and radial plain bearing" (RBP) scheme. In latter case the main load portion is transmitted through roller and ball bearings. End plain bearings are of an auxiliary importance.

The most advanced developments of "Baker Hughes" and "Security Dresser" U.S. companies (1,2) are the rock drill bits with a RBRP support scheme. In these designs the end radial plain bearing is replaced with a rolling bearing, from the plain bearings remaining only thrust bearings in a form of a journal at the trunnion end and an intermediate ring thrust bearing arranged on a shoulder of the locking ball bearing directed to a bit centerline.

It is commonly known that for cooling the support and removing the drilled rock cuttings from it, there is used blowing the support with compressed air. This measure, nevertheless, is insufficient for reliable heat removal. That's why, it is desirable to reject completely from using the plain bearings in the support unit.

A sliding friction coefficient is almost by an order of magnitude higher than a rolling friction coefficient, particularly, in the non-sealed support working without lubrication. Use of the plain bearings in the support in order to avoid overheating compels to reduce a power applied to the bit and transmitted to the hole face mainly through limiting a revolution rate to the level of 40–60 rpm in cases where it is impossible to reduce a load on the bit due to the drilled rock strength. Altogether, it results in reduction of a mechanical rate of penetration.

Apart from the thermal overstrain, the plain bearing use leads to an increase of the reactive moment, i.e. an anti-torque moment with respect to the cone revolution. And this results in developing an additional transverse component at the cone inserts which in its turn causes their failure and wear in a form of blunted areas since drilled rocks are characterised by high abrasiveness and strength.

Analysis of bits weared in rock drilling showed that the weakest unit in existing designs of supports under the RBR scheme is a locking radial thrust ball bearing. It is natural, since in this support scheme the ball bearing is a sole bearing receiving the total load component which is directed along the trunnion centerline whereas a component directed perpendicular to the trunnion centerline is received by all the support bearings including the ball bearing.

Inadequate efficiency of the ball bearing manifests itself in three aspects. Firstly, on its working surfaces on the trunnion and balls there appear fatique contact damages earlier than in roller bearings. Secondly, due to the overstrain the balls crack which results in a subsequent disastrous support wear. And, in the third place, a trunnion working shoulder for the ball bearing (directed to the hole wall), as a rule, at a definite working stage is either sheared off due to fatigue strains or it bends aside when there appears a creep restraining the most powerful radial bearing arranged adjacent to the trunnion base. In a case of the shoulder failure, the peripheral bearing rollers loose a direction and turn around in the race and, in a case of a roller restraining, this bearing becomes a peculiar plain bearing. Both cases result in a forced support destruction and the bit failure.

In Russia, numerous attempts have been made to eliminate overloading the locking ball bearing by reducing the radial roller bearings number in the support and simultaneous increase of the radial thrust ball bearings number up to two or even three units. During a certain period of time there were produced rock bits of size 214 mm with a double-row ball support, i.e. the ball bearings have been arranged adjacent to the trunnion base and in the center, with radial roller bearing being disposed at the trunnion end (a BBR support scheme). However, said support has not been successful since in this case the ball bearing located adjacent to the trunnion base became overloaded. In this case its overloading originated from a radial load directed perpendicular to the trunnion centerline. As a result, the previous RBR support scheme was accepted again and it is used up to present moment.

The European and U.S. companies have developed a combined rolling/plain support in which a load component directed along the trunnion centerline is received by a radial thrust ball bearing interacting with two or one thrust plain bearing(s) and a part of the radial load is accepted by the end radial plain bearing in addition to the main peripheral roller bearing.

The thrust plain bearings use in the support essentially eliminates failures of the working shoulder of a ball bearing or its bending aside giving preference to said support over the above-mentioned RBR support. The end radial plain bearing leaves more free space in contrast to the roller bearing and makes it easier to solve the problem of arranging the equipment elements for efficient rock disintegration in the face central part.

However, when drilling with air cleaning of the hole face, this support, as it was mentioned above, requires a moderate operation in order to eliminate the plain bearings overheating.

SUMMARY OF THE INVENTION

The main object of the invention is to provide a rock drill bit possessing a strengthened radial thrust ball bearing in the support which is made, preferably completely, on the rolling bearings. Strengthening of the ball bearing is assured by using balls of increased diameter specifically related to the bit size.

Inasmuch as the outer profile of the cones and hence, their inner space for arranging the support are restricted by the bit size, a race diameter of the ball bearing in the cone varies in the negligible range depending on the definite design phylosophy. Moreover, a volume and, consequently, power of said bearing vary essentially with the applied ball diameter-whether it is large or small.

Table 1 shows relative ball sizes used in the prior art designs. Ratio K defines how many times a diameter (d) of the balls used in the locking bearing is less than a bit diameter Rock Cone Bit Sizes Versus Ball Sizes of Locking Bearings Used in the Support

| Bit Code | Ball Diameter of Locking Bearing (d), mm | Ratio Index of Ball and Bits Sizes: κ = D/d (D is a bit diameter) |
|---|---|---|
| I. Bits manufactured by Russia and Ukraine plants | | |
| III 215.9 0κ-PV | 12.7 | 17.00 |
| III 215.9 κ-PV | | |
| III 244.5 0κ-PV-3 | 15.875 | 15.4 |
| III 269.9 0κ-PV | 19.05 | 14.17 |
| III 320.00 0κ-PV | 22.225 | 14.4 |
| | 19.05 | 16.8 |
| 2. Bits manufactured by US companies | | |
| Baker Hughes | | |
| 9 ⅞ BH50XP | 14.288 | 17.55 |
| 10 ⅝ BH50XP | 15.875 | 17.00 |
| Security Dresser | | |
| 9 ⅞ SS6MJA | 14.288 | 17.55 |
| 10 ⅝ SS6MJA | 15.875 | 17.00 |
| Reed Tool Company | | |
| 9 ⅞ MC4 | 14.288 | 17.55 |

As it is seen from the Table, in produced in Russia bits, the balls used in the support have a diameter 14.17–17.0 times less than a bit diameter, while in U.S. made bits it is 17.0–17.55 times less.

The preferred embodiments according to the present invention which enable to increase essentially a life and dynamic load capacity of the ball bearing should have K value within the range K=13.2–11.3. Beyond K<11.3 (use of larger ball diameter) the ball bearing power continues to increase but this raises a bit failure likelihood due to excessive reduction of the trunnion race diameter. At K>13.2 a rolling friction increase in the ball bearing causes a bit wear-resistance reduction.

The second essential aspect of the ball bearing strenghening resides in a provision of the required trunnion working shoulder strength. It is achieved by a specific design relation between a diameter of a ball race groove bottom and a diameter of a peripheral roller bearing race on the trunnion.

Here, it is indispensible that the roller bearing bed on the trunnion is elevated over the groove bottom of the ball bearing by a value exceeding a half of a ball radius. Then the balls transmit a load to the trunnion not through a bracket shoulder but by thrusting to the trunnion core. It provides high shoulder strength with the minimum thickness of its edge.

BRIEF DESCRIPTION OF THE DRAWINGS

FIG. 1 is a sectional view of an embodiment of the claimed drill bit.

FIG. 2 is a sectional view of the bit lower part scaled up relative to FIG. 1 for better representation of the support elements.

FIG. 3 is a sectional view of a fragment of the ball and peripheral roller bearings scaled up relative to FIGS. 1 and 2 for better representation of the strengthened support ball bearing features.

DESCRIPTION OF THE PREFERRED EMBODIMENT OF THE INVENTION

FIG. 1 illustrates a cone drill bit 1 with a bit centerline 2 around which the bit revolves. The bit includes a body comprising three legs 3, only one of which is shown in the Figure. In its lower part each bit leg 3 includes a trunnion 4 on which there is mounted a cone 5 equipped with rock desintegrating elements 6 having a form of hard-alloy inserts (or steel teeth milled on the cone body). A support unit of the cone 5 (a bit support) is made on the rolling bearings and comprises a peripheral roller bearing 7, end radial roller bearing 8 and radial thrust ball bearing 9. Owing to the mentioned above rolling bearings, the cone 5 is able to revolve with the minimal reactive torque around the trunnion 4 transmitting a load from it to the drilled hole face. The cone 5 displacements along the trunnion 4 centerline are hampered by the ball bearing 9 acting simultaneously as a locking bearing—its balls after assembling are blocked by a lock pin 10 welded at 11.

The drill bit has the following support air system: a compressed air is delivered into the support through a passage 12 in the leg and passage 13 in the trunnion for cooling and removing the rock cuttings, then the compressed air expands and exits to the front zone of the drilled hole through spacings between rolling elements and through clearances between the trunnion and the cone and between the leg and cone end.

The claimed support structure comprises a radial thrust ball bearing in the trunnion central part and two radial roller bearings adjacent to its ends. Meanwhile, the sizes of the balls of the radial thrust bearing are larger than in the traditional designs. Owing to this, the bearing width and volume are drastically increased and total contact surfaces are also enlarged, while the outer bearing diameter restricted by the cone inner space remains the same. The ball bearing volume and mass increase with concurrent reduction of the rolling friction coefficient improves its durability and ability to withstand shock overloads.

In order to choose the best ball sizes for the radial thrust ball bearing, it is possible to use as a criterion the ratio K=D/d, where D is a diameter of the cone drill bit shown in FIG. 1 and FIG. 2 and d is a ball diameter shown in FIG. 3.

The preferred design values of K ratio are K=13.2–11.3, whereas the prior art values are K=17.55–14.2, as it was shown above.

Starting with K=13,2, there occurs essential strengthening of the ball bearing, the strength becoming more pronounced as the ball diameter increases. Nevertheless, when K value is less than K=11.3 there appears a serious danger of the trunnion failure since at practically constant outer bearing diameter, the ball size increase inevitably entails a trunnion race diameter reduction. Moreover, the ball diameter increase leads to appropriate raising a diameter of a bore for the lock pin 10 through which the balls are introduced in the race during assembling the bit, also resulting in weakening the trunnion.

In operation, under the face response the cone 5 tends to displace along the centerline of the trunnion 4 to the hole wall. The typical wear pattern of all bit support designs proves this, that is why a shoulder 16, adjacent to the side of the peripheral radial roller bearing 7, serves as the ball bearing working shoulder (see FIGS. 2 and 3). Said shoulder is simultaneously the guide shoulder for rollers of the bearing 7.

To provide the required strength of the working shoulder 16, it is necessary to elevate the surface of the trunnion race 17 adjacent to the peripheral bearing 7 over the bottom of ball bearing groove 18 by a value exceeding a half of the ball radius, i.e. by a value above 0.25 d, where d is a ball diameter of the bearing 9. In FIG. 3, this value is designated as h, thus h=(R1–R2)>0.25 d, where R1 is a radius of a trunnion race for the peripheral thrust roller bearing 7; R2 is a radius of a trunnion race on the groove bottom of the radial thrust ball bearing 9.

In the prior art designs, h value is equal to or less than 0.25 d, as a consequence the groove bottom is of the bearing 9 is not adequately buried into the trunnion relative to the roller race of the bearing 7 or it is even elevated over the race 17 of the roller bearing 7. Meanwhile, the working shoulder 16 acquires a bracket design and to provide its strengthening it is required to increase its thickness which results in reducing the space for arranging more powerful bearings.

In the claimed design the cone response forces are transmitted by the balls essentially or completely thrusting to the trunnion core. In this case, an upper part of the shoulder 16 serves only as a guide shoulder for the rollers of the bearing 7 and doesn't fail under the influence of axial forces when the bit is in operation.

EXAMPLE OF THE PREFERRED BIT EMBODIMENT SIZES

Tri-cone drill bits manufactured in accordance with the invention and bits with a traditional support unit were comparatively tested under operating conditions. In order to obtain the most reliable results both the test and traditional bits were almost similarly equipped. Air system design in the compared bits was also identical.

Sizes of the test cone drill bits were as follows. For hard, abrasive rocks there were used the bits of size 244,5 mm (9 ⅝ in.) equipped with hard-alloy inserts which heads were spherical. The new support design under the "roller-ball-roller" scheme has been manufactured according to the teaching of the invention. The balls of the radial thrust bearing had a diameter of 19.05 mm (¾ in.), K value being K=12.83. The roller race surface was elevated over the groove bottom by 7 mm, thus h=R1–R2=0,39 d.

Sizes of the bits with a traditional support unit used for comparison of the results were as follows: the bit size was 244.5 mm (9⅝ in.); the roller-ball-roller support design. Ball size of the locking radial thrust bearing was: d=15.875 mm (⅝ in.); K=15.4. The race surface was elevated over the groove bottom by 0.7 mm, i.e. h=0.045 d.

When drilling blast holes in ferruginous quartzites of various hardness, a wear resistance has increased 3.2 times for formation hardness f=16 and 2.6 times for formation hardness f=20.

REFERENCES CITED

1. Baker Hughes Mining Tools. Product Catalog, 1991, BMT 90286/10 M/7-91
2. Security Mining Bit Catalog Order 6165-1M BHB -390/3–5M, 1991

We claim:

1. A cone drill bit comprising a bit body for thread jointing to a drill string, said body including three extending legs upon it;

trunnions made as an integral part of each said legs and extending transversely therefrom;

a set of inlet and outlet blowing passages interlinked and arranged in the bit body, legs and trunnions;

multi-crown cones mounted on the trunnions and outwardly equipped with hard-alloy inserts attached to the cone body or steel teeth milled on the cone body;

a support unit for rotatably mounting each cone on the trunnion, each support unit including a locking radial thrust ball bearing arranged between a peripheral and end journal roller bearings, and also comprising a lock pin, a diameter (d) of the balls in the locking ball bearing being defined by the relation:

$$D/d=11.3–13.2,$$

where D is a bit diameter.

2. The cone drill bit of claim 1, wherein a radius of a race on the trunnion of the peripheral journal rolling bearing (R1) and a radius of a trunnion race on the groove bottom of the radial thrust ball bearing (R2) are related as R1–R2>0.25 d, where d is a ball diameter of the locking radial thrust ball bearing.

* * * * *

UNITED STATES PATENT AND TRADEMARK OFFICE

CERTIFICATE OF CORRECTION

PATENT NO. : 5,485,891
DATED : January 23, 1995
INVENTOR(S) : Brazhentsev, et al It is certified that error appears in the above-identified patent and that said Letters Patent is hereby corrected as shown below:

On the title page, item [19] "Vladimirovich, et al" should read --Brazhenstev, et al--
item [54] Inventors: "Brazhenstev A. Vladimirovich" should read --Andrey V. Brazhentser--

"Brazhenstev V. Pavlovitch" should read --Vladimir P. Brazhentsev-- item [73] Assignee: should read --Obshestvo S Organichennoi Otvetstvennostju "Nauchno-Proizvodstvennaya Firma Spetsstroyservis" ,Moscow, Russian Federation--

Signed and Sealed this

Twenty-third Day of April, 1996

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,485,891
DATED : January 23, 1996
INVENTOR(S) : Brazhentsev, et al It is certified that error appears in the above-identified patent and that said Letters Patent is hereby corrected as shown below:

On the title page, item [19] "Vladimirovich, et al" should read --Brazhenstev, et al--
item [54] Inventors: "Brazhenstev A. Vladimirovich" should read --Andrey V. Brazhentsev--

"Brazhenstev V. Pavlovitch" should read --Vladimir P. Brazhentsev-- item [73] Assignee: should read --Obshestvo S Organichennoi Otvetstvennostju "Nauchno-Proizvodstvennaya Firma Spetsstroyservis" ,Moscow, Russian Federation--

This certificate supersedes Certificate of Correction issued April 23, 1996.

Signed and Sealed this

Thirteenth Day of August, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,485,891
DATED : January 23, 1996
INVENTOR(S) : Brazhentsev, et al It is certified that error appears in the above-indentified patent and that said Letters Patent is hereby corrected as shown below:

On the title page, item [19] "Vladimirovich, et al" should read --Brazhentsev, et al--
item [75] Inventors: "Brazhenstev A. Vladimirovich" should read --Andrey V. Brazhentsev--

"Brazhenstev V. Pavlovitch" should read --Vladimir P. Brazhentsev-- item [73] Assignee: should read --Obshestvo S Ogranichennoi Otvetstvennostju "Nauchno-Proizvodstvennaya Firma Spetsstroyservis" ,Moscow, Russian Federation--

This certificate supersedes Certificate of Correction issued August 13, 1996.

Signed and Sealed this

Twenty-ninth Day of October 1996

Bruce Lehman

*Attest:*

BRUCE LEHMAN

*Attesting Officer*

*Commissioner of Patents and Trademarks*